United States Patent [19]

Mott

[11] Patent Number: 4,745,873

[45] Date of Patent: May 24, 1988

[54] METHOD AND APPARATUS FOR TOWING AND LAUNCHING A WATERBORNE CRAFT

[76] Inventor: Jerome G. Mott, 800 W. 65th St., Richfield, Minn. 55423

[21] Appl. No.: 93,493

[22] Filed: Sep. 4, 1987

[51] Int. Cl.[4] ..... B63B 21/64

[52] U.S. Cl. ..... 114/344; 114/366; 405/2

[58] Field of Search ..... 114/344; 280/414.1; 405/1-3, 7

[56] References Cited

U.S. PATENT DOCUMENTS

| | | | |
|---|---|---|---|
| 1,103,971 | 7/1914 | Kratky | 114/366 |
| 2,371,461 | 3/1945 | Newell | 114/344 |
| 3,720,967 | 3/1973 | Rice | 114/344 |

FOREIGN PATENT DOCUMENTS

| | | | |
|---|---|---|---|
| 738941 | 6/1980 | U.S.S.R. | 405/2 |

*Primary Examiner*—Joseph F. Peters, Jr.

*Assistant Examiner*—Jesûs D. Sotelo

*Attorney, Agent, or Firm*—Lawrence M. Nawrocki

[57] ABSTRACT

A system for towing and launching a waterborne craft (10). The system includes a pair of tracks (26) which are floatable and are streamed from the shore (16) onto the surface (28) of a body of water (14) into which the craft (10) is to be launched. A carriage (12) is provided for supporting the craft (10), the carriage (12) including a pair of wheels (18) which have concavities (24) formed in outer peripheral surfaces thereof. The concavities (24) receive the elongated, generally cylindrical, tubular tracks (26) therein so that, as the carriage (12) is fed from the shore (16) into the water (14), the tracks (26) will be maintained at a distance from one another approximating the distance between the wheels (18). Additionally, the tracks (26) which were floating on the surface (28) of the water (14) will be urged downwardly in the water (14) and onto the bottom (40) thereof. When not in use, the tracks (26) can be easily removed from the body of water (14).

7 Claims, 2 Drawing Sheets

METHOD AND APPARATUS FOR TOWING AND LAUNCHING A WATERBORNE CRAFT

TECHNICAL FIELD

The present invention deals broadly with the field of aquatic vessels. More narrowly, however, the invention is related to a technology dealing with the towing and launching of such a vessel. A preferred embodiment of the apparatus invention is one including tracks down which a trailer cradling a boat can be run in launching the boat, and wherein the tracks are readily put into place and easily removed from the body of water in which the vessel is to be launched, if desired.

BACKGROUND OF THE INVENTION

The applications to which small water craft are put runs the gamut from pollution control to recreational purposes. Numerous other applications fall in between.

Similarly, within the recreational application, numberous activities utilizing a small water vessel are encompassed. For example, such vessels are used in water skiing, fishing, and basic pleasure boating.

Typically, regardless of the intended application of a craft, the vessel or craft is, when maintained out of the water, cradled in a carriage. Such a carriage is able to be transferred from one location to another. Most frequently, the carriage takes the form of a trailer having skids supporting the hull of the craft, and at least one pair of coaxial wheels for motively supporting the carriage for movement.

Launching is accomplished by backing the trailer into a body of water into which the vessel is to be launched. If gripes are provided to hold the vessel on the carriage cradle, the gripes are removed prior to the backing of the trailer into the body of water. As the trailer enters the water and becomes submerged to an extent wherein the buoyancy of the craft will cause it to rise above the skids, the craft becomes sufficiently disengaged so that it can be maneuvered away from the support cradle. Once launching is completed, the trailer is typically, withdrawn from the water and maintained at a location on the shore proximate the launching site.

For various reasons, it is desireable to provide some means for running the trailer straight into the water generally perpendicular to the shoreline. For example, trailers known in the art can be fairly difficult to maneuver. If some means for controlling the direction which the trailer follows as it is backed into, for example, a lake is provided, a towing vehicle can be more efficiently utilized to accomplish the launching.

In industrial and commercial applications of waterborne craft, the provision of permanent tracks fixedly positioned at launching locations presents no aesthetic problem. Typically, such launching sites are at locations closely proximate other launching sites, and the whole area is characterized by an industrial or commercial atmosphere.

In the case of recreational boating launching sites, however, permanently-present tracks can prove to be an eyesore. With the current ecological trends and trends toward keeping recreational lakes in as pristine a condition as possible, permanently placed tracks can dramatically violate the primitive and unspoiled features of a lake.

Launching tracks currently available are such that removal at the end of a recreational season is difficult, if not impossible. This is the result of various factors such as the manufacture of the tracks out of heavy materials in response to a desire to maintain the tracks at a fixed distance from one another along their lengths. It is important to maintain such a spacing so that the wheels of, for example, a trailer carrying the vessel to be launched are able to ride along their corresponding tracks throughout the launching run of the trailer.

An additional problem is that, even if aesthetic considerations are not of concern, tracks are frequently not provided at inaccessible locations. Additionally, poorly maintained public access locations also are not provided with tracks.

Another significant problem is the maneuverability of trailers in which vessels to be launched are cradled. If the trailer is to be backed into the body of water using a towing vehicle, considerable skill and patience on the part of the person driving the towing vehicle are necessary. Even when the driver possesses these characteristics, many attempts are often necessary to accomplish a successful launching.

If the trailer is sought to be backed into the water manually, difficulties can be encountered because of the weight and cumbersomeness of the trailer and the cradled vessel. The energies of the person or persons seeking to launch the craft must be divided between urging the trailer toward and into the water, and maintaining the trailer from being diverted from the intended direction of launch.

It is to these problems existent in the prior art that the present invention is directed. It provides a method and apparatus for quickly and easily launching a craft after having provided streamable and recoverable rails for facilitating the launch.

SUMMARY OF THE INVENTION

The present invention, first, takes the form of an apparatus which facilitates towing of a small water craft to a launch location and launching of the craft upon the arrival at the launching site. The apparatus includes a pair of elongated tracks which are generally cylindrical in cross-section. The tracks are formed from tubular stock and are, thereby, provided with a hollow interior. The tracks are formed from a material so that they are sufficiently light to be streamable from the shore onto the surface of the body of water into which the waterborne craft is to be launched. The weight of the material in combination with the hollow interior provided, enables the tracks to float on the surface of the body of water. Each track is provided with an aperture in a portion of the track which is streamed onto the surface of the body of water. As pressure is applied to the tracks, therefore, to urge them downwardly under the surface of the water, water is able to enter into the interiors of the tracks so that they will sink and remain submerged. The apparatus further includes a carriage in which the craft to be launched is cradled and means for mounting the carriage for movement on the shore of, for example, a lake, and onto the bottom of the lake. The mounting means comprises a first pair of wheels, coaxial with respect to one another and spaced along their common axis. Each wheel is provided with an outer peripheral surface which is concave along the common axis. The concavity thereby defined in each of the wheel peripheral surfaces accomodates one of the tracks, a track being run through a corresponding concavity on the shore. As the carriage is moved from the shore onto the bottom of the body of water, the concavities formed in the outer peripheral surfaces of the wheels retain their corresponding tracks therewithin. Consequently, the tracks are urged downwardly in the water to the bottom of the body of water in which the craft is being launched. The tracks, thereby, become filled with water and will, when the carriage is removed, remain on the bottom. Concurrently, as the carriage is moved from the shore into the water, the tracks will be maneuvered laterally as are the wheels, and the tracks will be maintained at a distance substantially the same as that as which the wheels are spaced from each other.

Because of various considerations, it has been found that making the tracks from a plastic material is optimum. Such materials afford the appropriate weight and durability characteristics necessary for functioning for the track's intended purpose. It has been found that polyvinylchloride is a particularly appropriate material.

In order to facilitate both towing and launching, a tongue having a second pair of coaxial, spaced wheels can be provided. The wheels, to which the tongue is mounted can each have an outer peripheral surface, concave along an axis of the wheels, and the wheels can be spaced at the same distance as the first pair of wheels are spaced from one another. Each wheel of the second pair can, thereby, in view of mating of the tongue to the carriage in tandem, define, along with one of the wheels of the first pair, a common plane.

When the first and second pair of wheels are so oriented, each track can be run through the concavities of one of the first and second wheels which, together, define a common plane. Once the carriage is oriented on the tracks, therefore, stability for launching is provided.

The tongue can include a member which interconnects each of the second pair of wheels, and two struts which, in a preferred embodiment, are of similar lengths and are pivotally connected to the interconnecting member, at first ends thereof, at locations along the interconnecting member at opposite ends of that member. It is envisioned that the struts would be so pivotably mounted at locations of substantially the same distance from the opposite ends of the interconnecting member.

The struts can be pivoted to first positions wherein ends of the struts, remote from the ends by which they are pivotably attached to the interconnecting member, can be connected to the carriage at different locations on the carriage. A rigid structure is, thereby, provided wherein relative pivoting of the tongue with respect to the carriage is precluded. The locations at which the distal ends of struts are secured to the carriage can be such that the rigidity maintains the pairs of wheels in positions to define the common planes previously discussed.

For towing purposes, the struts can be pivoted forwardly and connected to one another. When the tongue is mated, in tandem, with the carriage, relative pivoting of the tongue relative to the carriage is afforded. Consequently, towing is facilitated, and damage to the wheels because of different turning radiuses is minimized.

The minimization of damage is particularly important when tires are fitted over the wheels for movement over paved roads. It is envisioned that the rim of a typical tubeless tire could function as the wheel, and a tire be fitted to the rim for transportation over paved roads.

The present invention also includes a method for towing and launching a waterborne craft. In the method, tracks as defined in accordance with the apparatus are provided. Those tracks are streamed on the surface of the body of water into which the craft is to be launched, a portion of the tracks remaining on the shore of the body of water. A carriage and carriage mounting means in accordance with the apparatus are also provided. The carriage is manuevered on the shore so that a segment of each of the tracks situated on the shore is run through the concavity of the outer peripheral surface of a different one of the wheels. The carriage is, thereafter, moved from the shore into the water and onto the bottom of the body of water. As the carriage is moved outward onto the bottom of the body of water, the wheels cause their corresponding tracks to be urged downwardly in the water and filled with water so that, after the carriage is withdrawn onto the shore, the tracks will remain on the bottom. Additionally, the tracks will become aligned on the bottom at a distance substantially the same as that at which the wheels are spaced from each other.

The present invention is, thus, an improved method and apparatus for towing and launching a waterborne craft. More specific features and advantages obtained in view of those features will become apparent with reference to the DETAILED DESCRIPTION OF THE INVENTION, the appended claims, and the accompanying drawing figures.

DETAILED DESCRIPTION OF THE INVENTION

Figure 1:
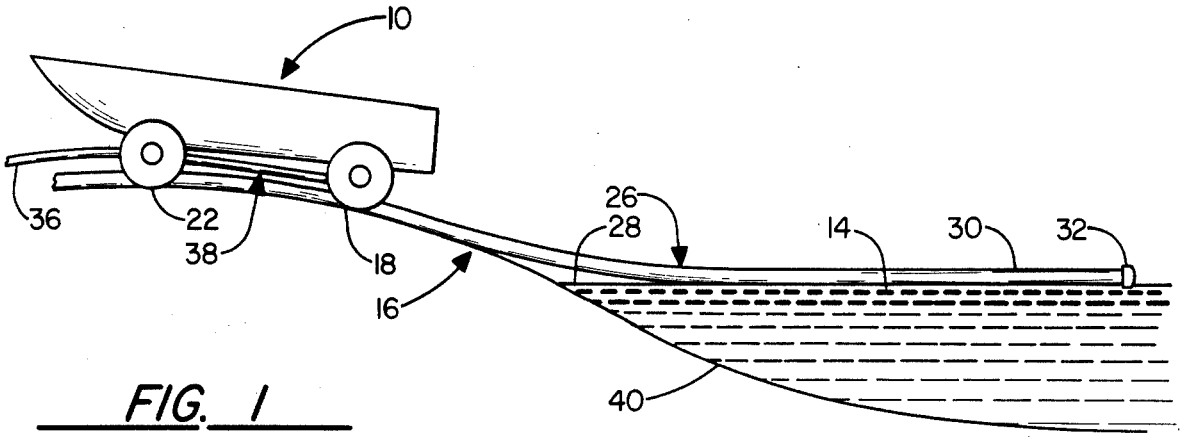
FIG. 1 is a side view of a craft, to be launched into a body of water, as it appears while still on the shore, tracks providing stability during launching received within concavities formed in various support wheels and being streamed on the surface of the water.
Figure 2:
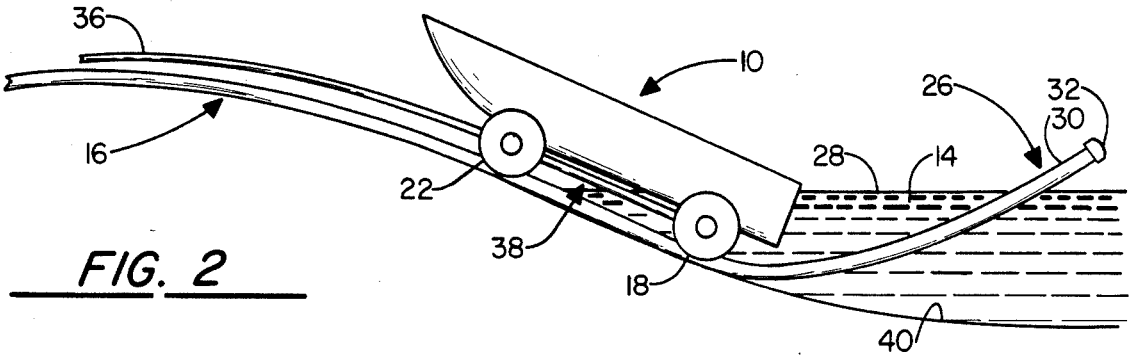
FIG. 2 is a view similar to FIG. 1 wherein the craft is in the process of being launched.
Figure 3:
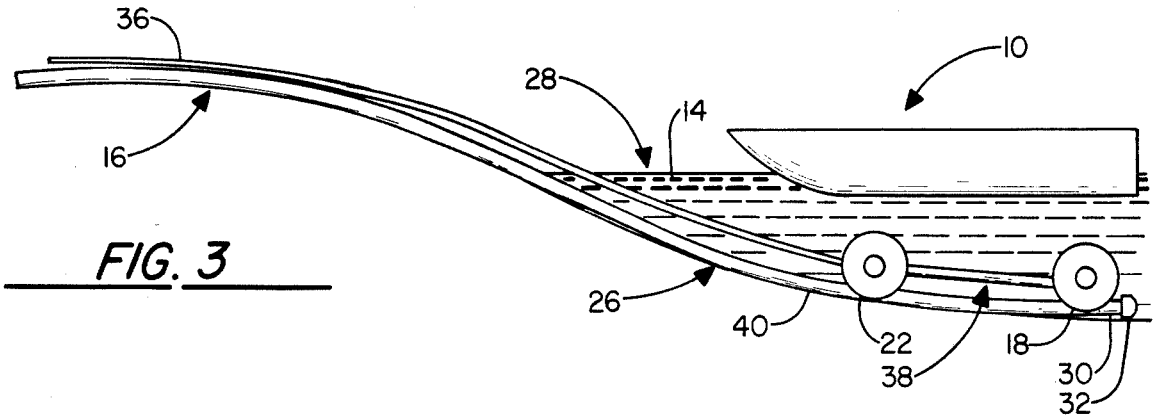
FIG. 3 is a view similar to FIGS. 1 and 2 after launching has been completed.
Figure 5:
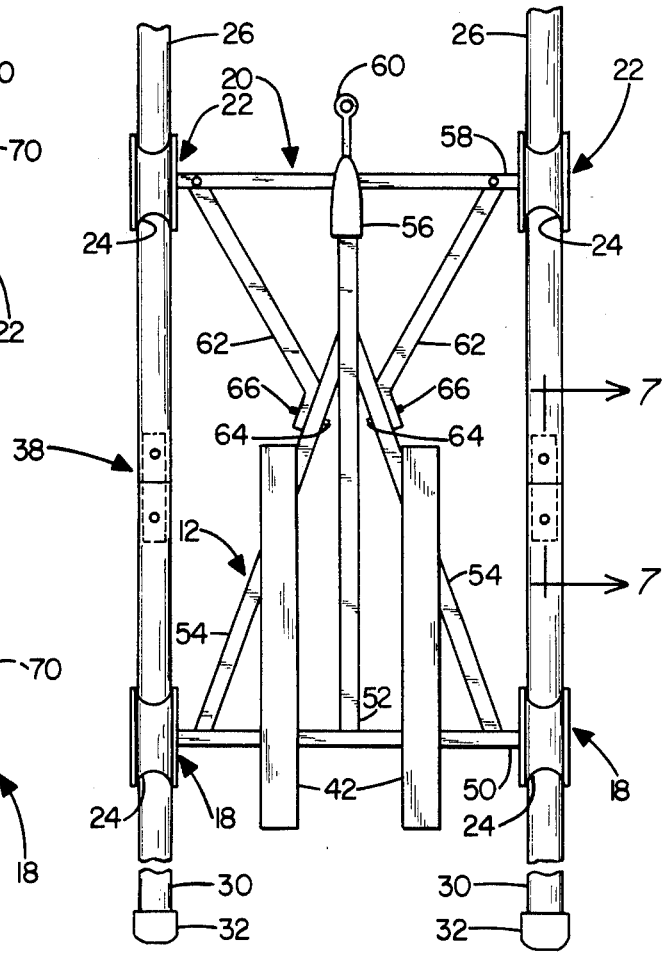
FIG. 5 is a view similar to FIG. 4, with the tongue struts in first positions to maintain the tongue rigid relative to the carriage.

Referring now to the drawings wherein like reference numerals denote like elements throughout the several views, FIGS. 1–3 illustrate a vessel 10, cradled in a carriage 12, which is in the process of being launched into a body of water 14, such as a lake. FIG. 1 illustrates the craft 10 on the shore 16 and supported by the carriage 12 by which it has been transported. The carriage 12 has a pair of wheels 18, as does a tongue element 20 mated, in tandem, with the carriage 12. FIG. 5 best illustrates the relationship between the tongue 20 and carriage 12 during launching and will be discussed hereinafter.

Again, referring briefly to FIG. 5, it can be seen that the wheels 18, 22 of the tongue 20 and the carriage 12 have concavities 24 provided in the outer peripheral surfaces thereof. The concavities 24 are of a shape and size so as to accomodate a pair of tracks 26, each track 26 being accommodated within the concavity 24 of one of each pair of carriage and tongue wheels 18, 22 which, together, define a common plane.

Referring again to FIG. 1, the tracks 26 are streamed onto the surface 28 of the body of water 14. They are elongated, cylindrical, tubular members which are, at their outer ends 30, closed with respective end caps 32. It is envisioned that the members, which function as tracks 26 for launching the craft 10, would be made from a light-weight, durable material such as plastic. Polyvinylchloride has been found to be the optimum material of which the tracks 26 can be manufactured.

Figure 6:
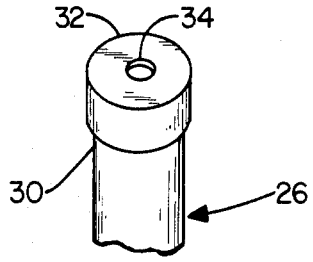
FIG. 6 is a perspective view of an end of one track illustrating an aperture formed therein.

While the ends 30 of the tracks 26 are closed by the end caps 32, as previously discussed, FIG. 6 illustrates that each end cap 32 can be provided with an aperture 34. When a material such as polyvinylchloride is used, the tracks 26, when streamed, will float on the surface 28 of the water 14 because of the light-weight nature of the material and the fact that the interior is hollow. The aperture 34 will tend to be maintained above the surface 28 of the water 14 so that water 14 cannot enter the track 26.

FIG. 2 illustrates the carriage-supported craft 10 as being allowed to slowly pass down the incline of the shore 16 into the water 14. This can be effected by providing a tensioning means such as a rope 36. One end of the tensioning means 36 is secured to an assembly 38 of the tongue 20 and carriage 12, and, as the rope 36 is payed out, movement of the assembly 38 is accomplished.

As seen in FIG. 2, those portions of the tracks 26 immediately beneath the carriage/tongue assembly 38 will be driven to the bottom 40 of the lake 14. As long as the apertures 34 in the end caps 32 remain above water 14, the remaining portions of the tracks 26 will tend to remain on the surface 28.

Eventually, however, the carriage/tongue assembly 38 will be sufficiently far out in the water 14 so that the end caps 32 will become submerged. As this occurs, water will enter into the interior of the tracks 26 through the apertures 34 in the end caps 32, and the tracks 26 will sink. The weight of the carriage 12 has, of course, already driven the tracks 26 to the bottom. As water fills the tracks 26, however, they will remain on the bottom 40 even if the carriage 12 is withdrawn back onto the shore 16.

As seen in FIG. 3, the carriage/tongue assembly 38 eventually becomes submerged to a depth sufficient so that the craft 10, previously cradled therein, rises from the skids 42 of the carriage 12 because of the craft's buoyancy. Typically, when this occurs and the vessel 10 is well free of the skids 42, the carriage/tongue assembly 38 is withdrawn back to the shore 16, launching having been completed. As previously indicated, the tracks 26 will remain on the bottom 40 and can be permitted to do so as long as is desired.

Figure 7:
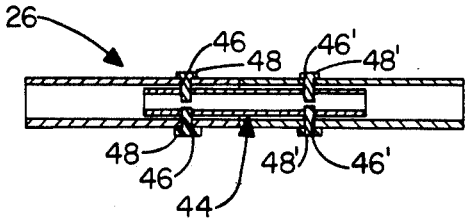
FIG. 7 is side sectional view taken generally along the line 7—7 of FIG. 5.

If the craft 10 is to be maintained, while in the water, at a pier or dock (not shown) for any appreciable time, the tracks 26 can be withdrawn onto the shore 16 and be stored in a garage, pole barn, or other appropriate structure. Because of the lengths of tracks typically necessary, the tracks 26 can be segmented to facilitate storage. FIG. 5 illustrates the mating of adjacent ends of segments to provide for sufficiently long tracks. FIG. 7 illustrates the mating structure in more detail.

As previously discussed, the tracks 26, and segments thereof, therefore, are hollow in that they are tubular. In order to effect mating, a dowel-like structure 44 having an outer diameter closely approximating the inner diameter of one segment of the track 26 can be fitted into an end of that segment. Both the track segment and dowel-like member 44 can be provided with apertures 46 which, when the dowel-like member 44 is in a proper position relative to the segment, are aligned. Pins 48 can be inserted through the registered apertures 46 to maintain the dowel-like member 44 relative to the segment of track.

Thereafter, a second segment of track can be maneuvered into position so that the extending portion of the dowel-like member 44 can be received therein. Again, apertures 46′ which can come into alignment can be provided, and when those apertures 46′ are registered, appropriate pins 48′ can be inserted to effect completion of mating.

Referring now to FIG. 5, the carriage 12 is illustrated as having a pair of wheels 18, previously described, spaced along an interconnecting member 50. Generally centrally and substantially perpendicular to the interconnecting member 50 is a centerline horizontal support 52 which extends forwardly from the interconnecting member 50. A pair of oblique horizontal supports 54 are, for example, welded to the interconnecting member 50, at rearward ends thereof, and to the centerline support 52, at forward ends thereof, to afford rigidity to the carriage 12. The skids 42 are, in turn, mounted atop the support structure by appropriate means. The means of mounting the skids 42 is in accordance with a manner known in the prior art.

The centerline support 52 carries a hitch 56 at its forward end. In the configuration illustrated in FIG. 5, the hitch 56 is mated to an interconnecting member 58 of the tongue, and an eye 60 is mounted to the hitch 56 for towing and launching purposes.

The tongue 20 has an interconnecting member 58, as does the carriage 12, interconnecting and spacing at a fixed distance a second pair of wheels 22. The wheels 22 are spaced at a distance substantially the same as are the carriage wheels 18 so that, when the tongue 20 and carriage 12 are mated together as illustrated in FIG. 5, one wheel of each pair 18, 22 will be able to ride on one of the tracks 26.

The tongue 20 further includes two struts 62, each being pivotably connected at one end thereof to the interconnecting member 58 proximate one of opposite ends of the interconnecting member 58. In order to afford symmetry, the struts 62 are of similar lengths and are pivotably mounted to the interconnecting member 58 at similar distances from the opposite ends of the interconnecting member 58.

FIG. 5 shows the struts 62 in first positions wherein ends of the struts 62 opposite the ends by which they are pivotably mounted to the interconnecting member 58 are connected to the oblique horizontal supports 54 of the carriage 12. Because these points of connection are at spaced locations on the carriage 12, the orientation of the interconnecting member 58 of the tongue 20 can be maintained parallel of the interconnecting member 58 of the carriage 12. A rigidity which affords and fosters maneuverability is, thereby, provided.

Connection of the distal ends of the struts 62 can be effected in any appropriate manner. Alignable holes in the various members can be provided, and, when the holes are brought into registration, a headed bolt 64 can be inserted and a nut 66 secured to a threaded end of the bolt 64.

It is in this configuration that launching would be effected. If launching is being performed manually (that is, other than by a towing vehicle), the total energies of the people effecting the launching can be directed generally parallel to the lie of the track members 26. Because of the rigidity, and in view of the track members 26 being received within the concavities of the wheels 24, there will not be any tendency for the carriage 12 to become misdirected away from an intended direction of movement.

Recovery of the craft 10 is accomplished in a manner inverse to that described for launching. As previously stated, the tracks 26 will, very likely, have been recovered and stored in order to maintain the aesthetic appearance of the, for example, lake 14 into which the craft 10 has been launched. When recovery of the boat 10 is necessary, the tracks 26 can be reassembled and streamed on the surface 28 of the body of water 14. The carriage 12 and tongue 20, configured as in FIG. 5, can, thereafter, be run out into the water 14 with the tracks 26 received in the concavities 24 of the various wheels 18, 22. The tracks 26 will, thereby, be again placed in desired locations. With the carriage/tongue assembly 38 submerged, the craft can be brought into a position approximately directly above the carriage/tongue assembly 38. That assembly 38, can, be drawn toward the shore 16 on the tracks 26. Concurrently, the craft 10 is drawn toward the shore 16 to be maintained as closely as possible above the assembly 38, so that, when the assembly 38 arises to a point where the craft 10 will come into engagement, the skids 42 will be at a position relative to the craft 10 so that the craft 10 can be received thereon. The assembly 38 is, thereafter, drawn from the water 14. If desired, the tracks 26 can, again, be removed.

Figure 4:
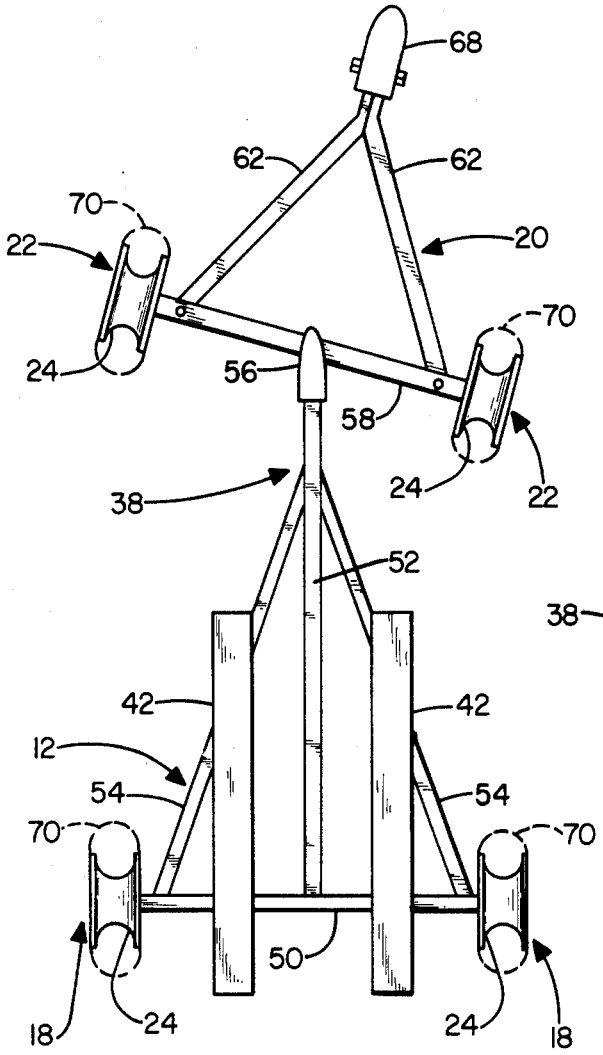
FIG. 4 is a top plan view showing a second configuration of the tongue struts wherein pivoting of the tongue relative to the carriage can be accomplished.

FIG. 4 illustrates a second configuration wherein the struts 62 of the tongue 20 are pivoted forwardly relative to the tongue's interconnecting member 58. In this configuration, the struts 62 are disconnected from the oblique horizontal supports 54 of the carriage 12, pivoted forwardly, and connected to one another and a hitch 68 which can be attached to a towing vehicle (not shown).

As can be seen in view of this disclosure, the hitch 56 attached to the centerline support 52 of the carriage 12 is mated to the interconnecting member 58 of the tongue 20 as is true in the case of the configuration illustrated in FIG. 5. This point of attachment, in the configuration of FIG. 4, however, is the only one provided between the tongue 20 and the carriage 12. Consequently, they will be free to pivot relative to one another. Towing on paved roads is, thereby, made easier.

Another adjustment illustrated in FIG. 4 is one wherein tire means 70 are fitted onto each of the wheels 18, 22. This adaption also facilitates movement of the tongue 20 and carriage 12 on paved roads.

If desired, standard wheel rims can be employed to function as the wheels 18, 22. Tire means 70 can, thereby, be easily fitted onto the rims in order to effect the adaptation discussed immediately above.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for towing and launching a waterborne craft, comprising:

(a) a pair of elongated, generally cylindrical, tubular tracks, said tracks being floatable and streamable from the shore onto the surface of a body of water into which the waterborne craft is to be launched, said tracks each having an aperture formed therein at a location therealong wherein, when said tracks are streamed on the surface of the body of water and downward pressure is applied thereto, water enters through said apertures and said tracks sink;

(b) a carriage for cradling the waterborne craft therein; and (c) means for mounting said carriage for movement on the shore of the body of water and onto the bottom of the body of water, said mounting means comprising a first pair of coaxial, spaced wheels, each having an outer peripheral surface, concave along an axis of said wheel, through which a segment of one of said trucks on the shore is run;

(d) wherein, as said carriage is moved from the shore of the body of water and outward onto the bottom of the body of water, said wheels cause their corresponding tracks to be urged downwardly in the water and fill with water, and to be aligned on the bottom of the body of water at a distance substantially the same as that at which said wheels are spaced from each other.

2. Apparatus in accordance with claim 1 wherein said tracks are tubular members made from a plastic material.

3. Apparatus in accordance with claim 2 wherein said tracks are tubular members made from polyvinylchloride.

4. Apparatus in accordance with claim 1 further comprising a second pair of coaxial, spaced wheels, each having an outer peripheral surface, concave along an axis of said wheel, through which a segment of one of said tracks on the shore is run, and a tongue, carried by said second pair of wheels, matable, in tandem, to a hitch of said carriage to enable disposing of each wheel of said second pair of wheels so as to define a common plane with one wheel of said first pair of wheels.

5. Apparatus in accordance with claim 4 wherein said tongue comprises a member interconnecting said second pair of wheels, and two struts, each strut being pivotally connected, at one end thereof, to said interconnecting member proximate one of opposite ends thereof, wherein ends of said struts remote from said ends at which they are connected to said interconnecting member are connectable, when said struts are disposed in first positions thereof, to said carriage at different locations thereon to preclude relative pivoting of said tongue with respect to said carriage and to dispose each wheel of said second pair of wheels to define said common plane with one wheel of said first pair of wheels, and, when said struts are disposed in second positions thereof to each other to render said tongue pivotable with respect to said carriage.

6. Apparatus in accordance with claim 4 further comprising tire means, fittable onto each of said wheels, to facilitate movement of said carriage and said tongue on a paved road.

7. A method for towing and launching a waterborne craft, comprising the steps of:

(a) providing a pair of elongated, generally cylindrical, tubular tracks, said tracks being floatable and streamable from the shore onto the surface of a body of water into which the waterborne craft is to be launched, said tracks each having an aperture formed therein at a location therealong at a distance from the shoreline to admit water into the interior of the track;

(b) streaming said tracks on the surface of the body of water into which the waterborne craft is to be launched with a portion of said tracks remaining on the shore of the body of water;

(c) providing:

(i) a carriage for cradling the waterborne craft therein; and (ii) means for mounting said carriage for movement on the shore of the body of water and onto the bottom of the body of water, said mounting means comprising a pair of coaxial, spaced wheels, each having an outer peripheral surface, concave along an axis of said wheel;

(d) maneuvering the carriage on the shore so that each of the tracks is run through the concavity in the outer peripheral surface of a different one of the wheels; and (e) moving the carriage from the shore of the body of water and outward onto the bottom of the body of water;

(f) wherein, as said carriage is moved from the shore of the body of water and outward onto the bottom of the body of water, said wheels cause their corresponding tracks to be urged downwardly in the water and fill with water, and to be aligned on the bottom of the body of water at a distance substantially the same as that at which said wheels are spaced from each other.

* * * * *